US009205015B2

(12) United States Patent
Guillen

(10) Patent No.: US 9,205,015 B2
(45) Date of Patent: Dec. 8, 2015

(54) LINEAR MOTION THERAPY DEVICE

(76) Inventor: Lawrence Guillen, Farmington, NM (US)

( * ) Notice: Subject to any disclaimer, the term of this patent is extended or adjusted under 35 U.S.C. 154(b) by 712 days.

(21) Appl. No.: 13/557,341

(22) Filed: Jul. 25, 2012

(65) Prior Publication Data

US 2014/0031728 A1 Jan. 30, 2014

(51) Int. Cl.
*A61H 1/02* (2006.01)
*A61H 1/00* (2006.01)

(52) U.S. Cl.
CPC ..... *A61H 1/0259* (2013.01); *A61H 1/00* (2013.01); *A61H 1/02* (2013.01); *A61H 1/0237* (2013.01); *A61H 1/0255* (2013.01); *A61H 2201/1215* (2013.01); *A61H 2201/1253* (2013.01); *A61H 2201/149* (2013.01); *A61H 2201/163* (2013.01); *A61H 2201/1621* (2013.01); *A61H 2201/1642* (2013.01); *A61H 2201/5064* (2013.01); *A61H 2201/5097* (2013.01); *A61H 2203/0456* (2013.01)

(58) Field of Classification Search
CPC ..... A61H 1/00; A61H 1/001; A61H 1/02; A61H 1/0237; A61H 1/024; A61H 1/0244; A61H 1/0255; A61H 1/0259; A61H 1/0262; A61H 2201/12; A61H 2201/1207; A61H 2201/1215; A61H 2201/123; A61H 2205/106; A61H 2205/08; A61H 2205/083; A61H 2205/088; A61H 2203/0456; A61H 2201/5064; A61H 2201/1642; A61H 2201/5097; A61H 2201/1253; A61H 2201/149; A61H 2201/1621; A61H 2201/163; A61F 5/02; A61F 5/028; A61F 5/0193
USPC ..... 606/241, 245; 602/32–36
See application file for complete search history.

(56) References Cited

U.S. PATENT DOCUMENTS

| | | | | | |
|---|---|---|---|---|---|
| 2,058,563 | A | | 12/1934 | Campbell | |
| 3,404,679 | A | * | 10/1968 | Bevilacqua | A61F 5/04 606/242 |
| 4,089,330 | A | | 5/1978 | Nicolosi et al. | |
| 4,222,376 | A | | 9/1980 | Praprotnik | |
| 4,481,941 | A | * | 11/1984 | Rolfes | A61F 5/0102 602/19 |
| 4,492,222 | A | | 1/1985 | Hajianpour | |
| 4,637,379 | A | * | 1/1987 | Saringer | 601/34 |
| 4,665,899 | A | | 5/1987 | Farris et al. | |
| 4,751,917 | A | * | 6/1988 | Ruf | 601/34 |
| 4,825,852 | A | * | 5/1989 | Genovese et al. | 601/34 |
| 4,834,073 | A | | 5/1989 | Bledsoe et al. | |
| 4,957,103 | A | * | 9/1990 | Young et al. | 602/19 |
| 4,974,830 | A | | 12/1990 | Genovese et al. | |
| 4,979,732 | A | * | 12/1990 | Rushatz et al. | 482/148 |
| 5,239,987 | A | * | 8/1993 | Kaiser et al. | 601/34 |
| 5,280,783 | A | * | 1/1994 | Focht et al. | 601/34 |

(Continued)

*Primary Examiner* — Justine Yu
*Assistant Examiner* — Tu Vo
(74) *Attorney, Agent, or Firm* — Dennis F. Armijo

(57) ABSTRACT

A linear motion therapy device that has a single semi-enclosed worm-driven actuator (guide bar) with one end attached to a cantilevered and adjustable foot and heel support. The opposite end of the actuator is attached to a corset the person wears while in a supine position called a thoracic lumbar spine orthosis (TLSO). Next to the corset, but attached to the actuator is a motor, a height adjustment screw, and a stabilizer plate. A cord is attached to a push button hand control device for moving the foot support along the guide bar in a forward or reverse direction. Movement can be stopped at any time. A patient also wears a constraint that wraps around the thigh called a thigh support that attaches to the actuator with a pivotal and adjustable arm. This device can be adjusted to either leg.

20 Claims, 9 Drawing Sheets

(56) References Cited

U.S. PATENT DOCUMENTS

| | | | | |
|---|---|---|---|---|
| 5,419,752 | A * | 5/1995 | James | A61H 1/02 482/51 |
| 6,702,770 | B2 * | 3/2004 | Bremer | A61F 5/055 602/19 |
| 6,899,689 | B1 * | 5/2005 | Modglin | 602/19 |
| 7,244,238 | B2 | 7/2007 | March et al. | |
| 7,282,035 | B2 * | 10/2007 | Huang | 601/5 |
| 7,309,320 | B2 | 12/2007 | Schmehl | |
| 7,744,546 | B2 | 6/2010 | Lee | |
| 7,762,963 | B2 | 7/2010 | Ewing | |
| 8,070,659 | B2 | 12/2011 | Gagnon et al. | |
| 2003/0120186 | A1 | 6/2003 | Branch et al. | |
| 2003/0135137 | A1 * | 7/2003 | Splane, Jr. | 601/24 |
| 2006/0064044 | A1 * | 3/2006 | Schmehl | 601/34 |
| 2009/0163837 | A1 | 6/2009 | Sanger et al. | |
| 2012/0232438 | A1 * | 9/2012 | Cataldi et al. | 601/5 |

* cited by examiner

LINEAR MOTION THERAPY DEVICE

BACKGROUND OF THE INVENTION

1. Field of the Invention (Technical Field)

The presently claimed invention relates to therapy apparatuses, and more particularly, to a linear motion therapy device for enabling full range of motion for knee or hip problems. A mechanized linear motion therapy device (LMTD) is used after surgery for gentle knee or hip flexion and can be used on an inpatient or an outpatient basis.

2. Background Art

There are several devices in the marketplace for providing physical therapy to a patient after knee or hip surgery; however, most of these devices are for use right after surgery.

Some of these include:

Continuous passive motion (CPM) devices are used during the first phase of rehabilitation following a soft tissue surgical procedure or trauma. CPM is carried out by a CPM device, which constantly moves the joint through a controlled range of motion and provides passive motion in a specific plane of movement. The shortcomings of CPM machines are that they are used only immediately after surgery and up to four weeks afterwards; the device is heavy and difficult for some people to handle when sitting on a surface, it tilts to one side or another, and it is difficult to fit properly for a person with less than a twenty five inch (25") leg length. Therapeutically, it only approximates calibration of the flexion of the knee, tends to move away from the person using it, thus, not targeting the knee joint which needs to be bent. The CPM spends little time at the height of the knee flexion or at extension because of its continuous motion action and does not completely extend the leg to put femur and tibia into traction for some patients.

Manual therapy is currently being used which includes heel slides whereby the patient lies with his or her back while on a table, bed, or floor with a strap or fastener under the foot and slides the heel closer to the buttocks while holding the strap. When the patient can no longer bend the knee on his/her own, he/she pulls on the ends of the strap to flex the knee further. A physical therapist assistant (PTA) or physical therapist (PT) can also push on the leg to get the maximum flexion. The PTA or PT may then measure the amount of flex with a goniometer. Another in-house therapy method includes use of a heel prop whereby the patient lies on his or her back while on a table, bed, or floor with the postoperative leg fully extended. The heel of this leg is placed on an item such as a rolled up towel, a half-round plastic roll, or other object that keeps the knee fully extended and clears the girth of the calf. At home, the patient may not do the exercises as prescribed; may do them improperly, or not at all. Further, it requires the time of a PT or PTA to teach and then observe to make sure that the patient does the therapies properly.

NK™ tables are also used for therapy. A patient sits on the NK™ table and the postoperative knee/hip is strapped down at the thigh. The knee is then bent to a degree that the patient can tolerate. A long bar with a perpendicular bar to hold weights is attached at the end. Weights are added as needed for resistance to keep the bend. The entire long bar can be adjusted according to the type of bend required. Set up time takes a very long time and cannot be used in a home setting. It does not keep the hip from hiking (moving up) nor does it keep the patient from leaning side to side, thus, keeping the knee from flexing properly or in correct alignment. This device takes time for a PT or PTA or technician to get the patient set up, adjust the device, place the proper weights on the machine, and it cannot be used at the patient's home.

The prior art devices fail to allow a patient to get a true bend and precisely measure the bend. The measurement of bend provides positive reinforcement and motivation to a patient. The presently claimed invention provides a positive environmental setting whether at a therapy location or at home. It is also important because the patient has a very short window of time to improve the bend and break through scar tissue. The thoracic lumbar spine orthosis (TLSO)/back support and thigh support in the presently claimed invention, keep the patient in the correct position unlike manual therapy or slides, which allow too much side to side movement and can also move away from the bend. These aforementioned prior art therapies are inconsistent. Without daily practice, the patient may not improve and once or twice a day is not enough to continue improvement. The claimed invention is for use four weeks after surgery, and is not continuously, but manually controlled by the patient using the device. Further, the claimed invention is adaptable to each patient, and is relatively light (20 pounds) which makes the apparatus easy to handle.

SUMMARY OF THE INVENTION

Disclosure of the Invention

The presently claimed invention solves the aforementioned problems and shortcomings of the prior art by providing a lightweight and inexpensive therapy apparatus and method for an ever increasing range of motion for the postoperative patient. More particularly, the presently claimed invention is for use after the first four weeks postoperative inpatient or outpatient use.

In one embodiment the linear motion therapy apparatus comprises a base with a driven worm-drive, a thoracic lumbar spine orthosis (TLSO) affixed to the base, a thigh support assembly affixed to a movable arm, the moveable arm affixed to the base, a footpad assembly affixed to a worm receiver disposed on the worm-drive and an apparatus to provide clockwise and counterclockwise rotation to the worm-drive and provide telescopic linear movement to the footpad assembly. The footpad assembly can be a pivoting footpad and have at least one strap to secure a foot inserted into the footpad and a heel cup and have at least one stop to prevent the footpad from pivoting beyond a predetermined number of degrees. The footpad assembly can have a removable foot support for affixing to the footpad assembly for a left or a right foot. The TLSO can be removable for affixing to the base in a right or a left leg configuration. The TLSO can also be a two piece rigid outer shell with a plurality of shell apertures for adjusting the two piece outer shell for different sized torsos, have attachment assemblies on either side of the two piece outer shell assembly for affixing to the base for either the right or the left leg configuration, a cushion material disposed on an inside of the two piece outer shell, and at least one adjustable fastener to tighten and loosen the TLSO. The thigh support assembly can be a rigid semi circular support with cushion material disposed on an inside of the support and at least one adjustable thigh support fastener to secure and release a thigh. The moveable arm can have at least one aperture for affixing the adjustable arm to the base for a right or a left leg configuration, configured to allow the adjustable arm to move vertically and have a plurality of adjustment apertures to allow the thigh support assembly to accept different leg lengths. The apparatus to provide clockwise and counterclockwise rotation to the worm-drive can be a motor with controls to rotate the worm-drive in a clockwise or counterclockwise direction and to start and stop the rotation. The linear motion therapy apparatus can have supports affixed to the base to keep the base at a predetermined height above a surface. The linear motion therapy apparatus can have a measuring apparatus affixed to the base to measure a range of motion.

In another embodiment, a method for providing physical therapy targeted to a knee joint with a linear motion therapy device provides a base comprising a driven worm-drive, a thoracic lumbar spine orthosis (TLSO) affixed to the base, a thigh support assembly affixed to a movable arm, the moveable arm affixed to the base, a footpad assembly affixed to a worm receiver disposed on the worm-drive, and an apparatus to provide clockwise and counterclockwise rotation to the worm-drive. This also provides telescopic linear movement to the footpad assembly, placing the patient into the linear motion therapy device, activating the apparatus to provide rotation to the worm-drive in a first direction, deactivating the apparatus to provide rotation to the worm-drive, activating the apparatus to provide rotation to the worm-drive in a second direction, and deactivating the apparatus to provide rotation to the worm-drive. The method can also include configuring the TLSO, the thigh support assembly, and the footpad assembly for a selected leg. The method can also include adjusting the TLSO and thigh support assembly to fit the patient's torso and thigh, telescopically adjusting the footpad assembly to where the patient is able to place the foot on the footpad assembly, tightening foot support straps, tightening thigh support straps, and tightening TLSO support straps. The method of pushing at least one button and deactivating comprises releasing the at least one button on a hand held controller or pushing up on a first button to activate the motion in the first direction and pushing down on a second button to activate the motion in the second direction. The method can also include looking at a measurement indicator affixed to the base that corresponds to a location of the footpad assembly. This can also include the step of preventing the patient's back and hips from lifting off a surface when the TLSO is activated via the TLSO and allowing the patient's thigh to move vertically when the TLSO is activated via the thigh support.

An object of the presently claimed invention is to provide a versatile apparatus for increasing the patient's range of motion in the knee or hip. Another object of the claimed invention is to provide a therapy apparatus that can be used in an inpatient or outpatient setting and is adjustable to keep all parts in correct alignment for different sized individuals, accommodating either the right leg or left leg.

Advantages of the presently claimed invention are that the apparatus will decrease soft tissue stiffness and limit the continuing development of scar tissue. Another advantage is that it prevents an anterior pelvic tilt to eliminate increased lordosis and external rotation of the hip keeping the leg in alignment and emphasizing the knee bend without the leg moving medially or laterally.

Other objects, advantages and novel features, and further scope of applicability of the presently claimed invention will be set forth in part in the detailed description to follow. They will be taken in conjunction with the accompanying drawings, and in part will become apparent to those skilled in the art upon examination of the following, or may be learned by practice of the claimed invention. The objects and advantages of the claimed invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention, and together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

Best Modes for Carrying out the Invention

Figures 1A, 1B:
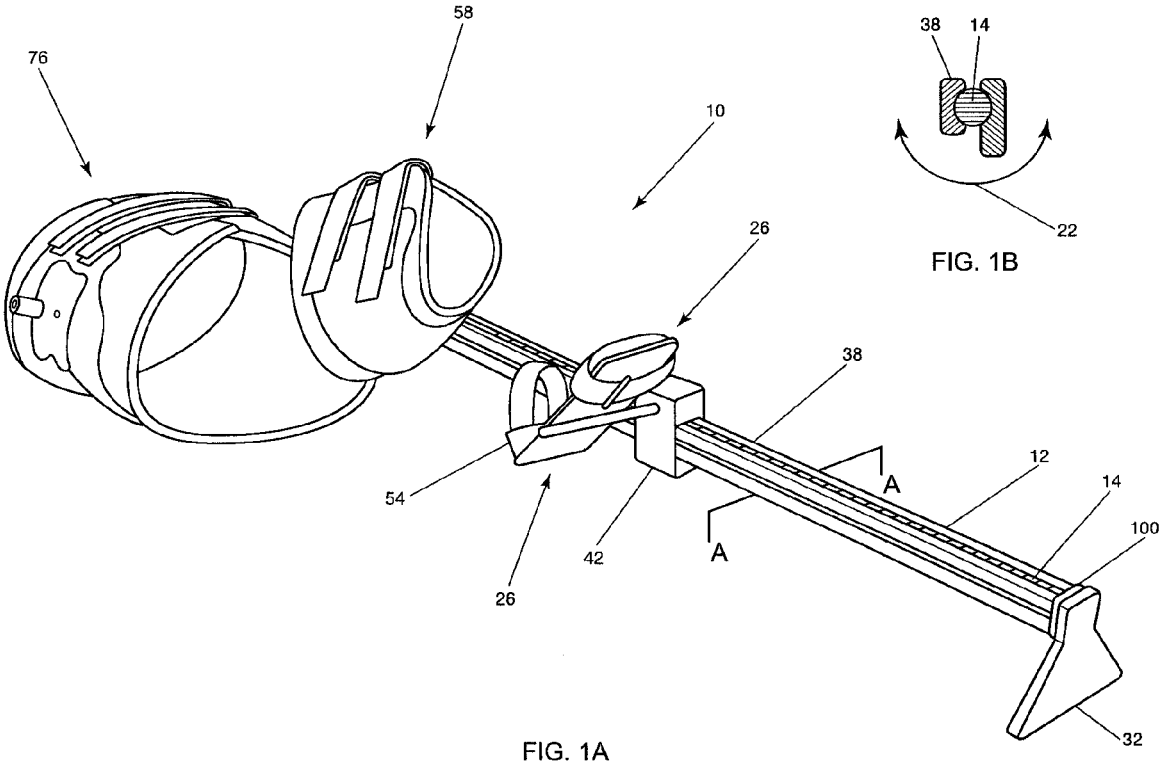
FIG. 1A is a perspective view of the preferred embodiment of the linear motion therapy device.
FIG. 1B is a cut out view along A-A of FIG. 1A.
Figure 4:
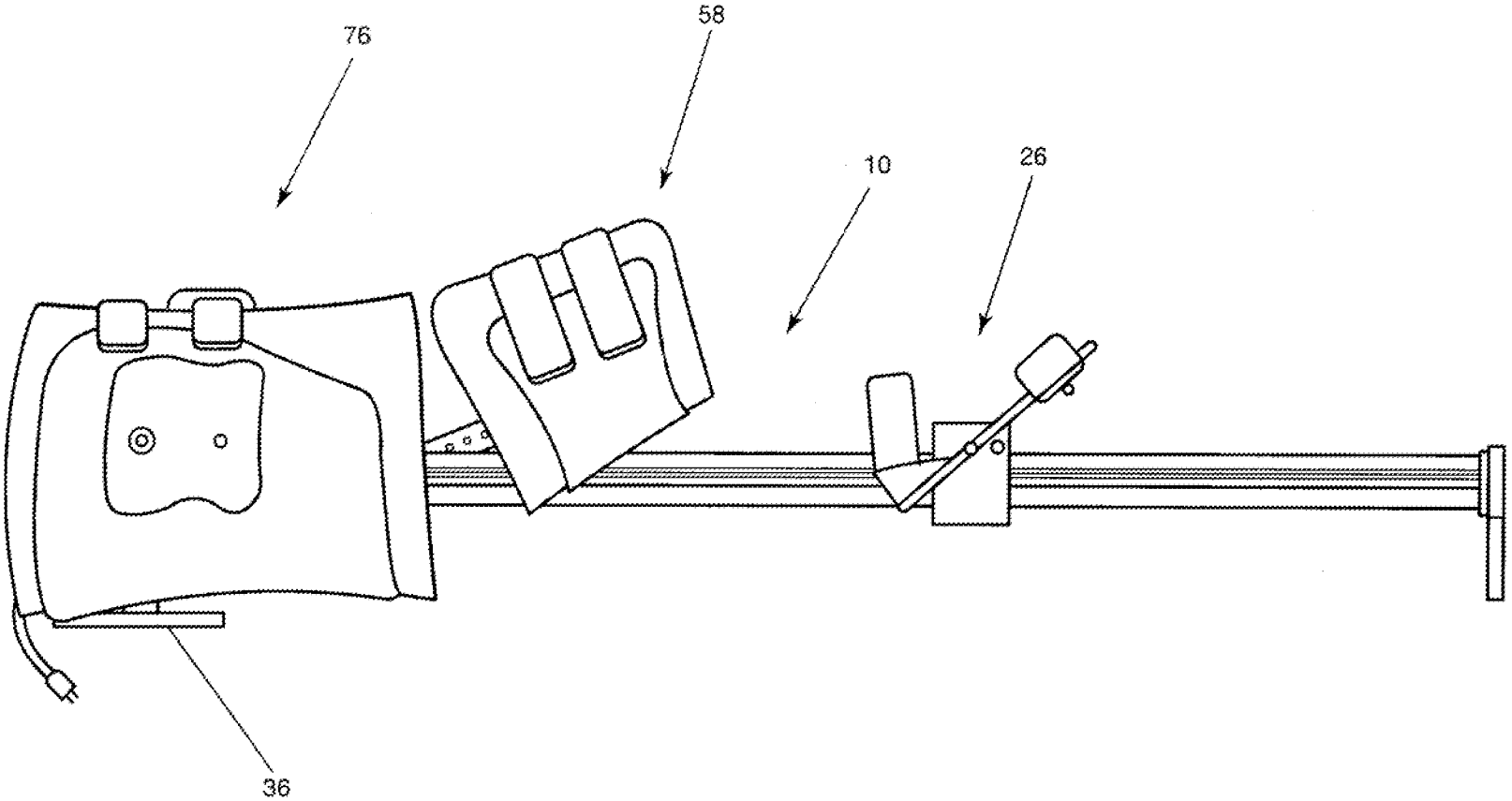
FIG. 4 is a right side view of the preferred linear motion therapy device.
Figure 5:
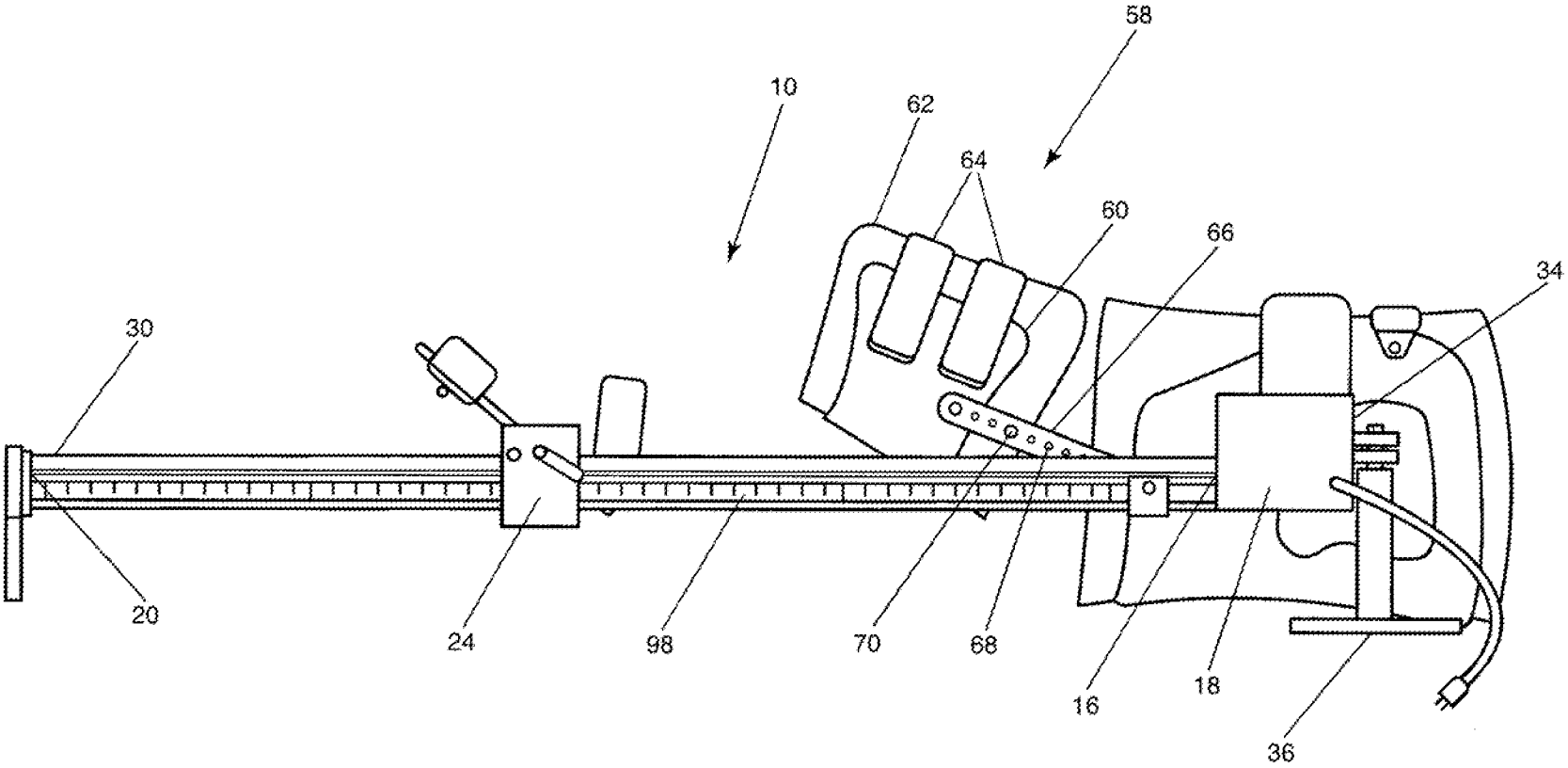
FIG. 5 is a left side view of the preferred linear motion therapy device.
Figure 6:
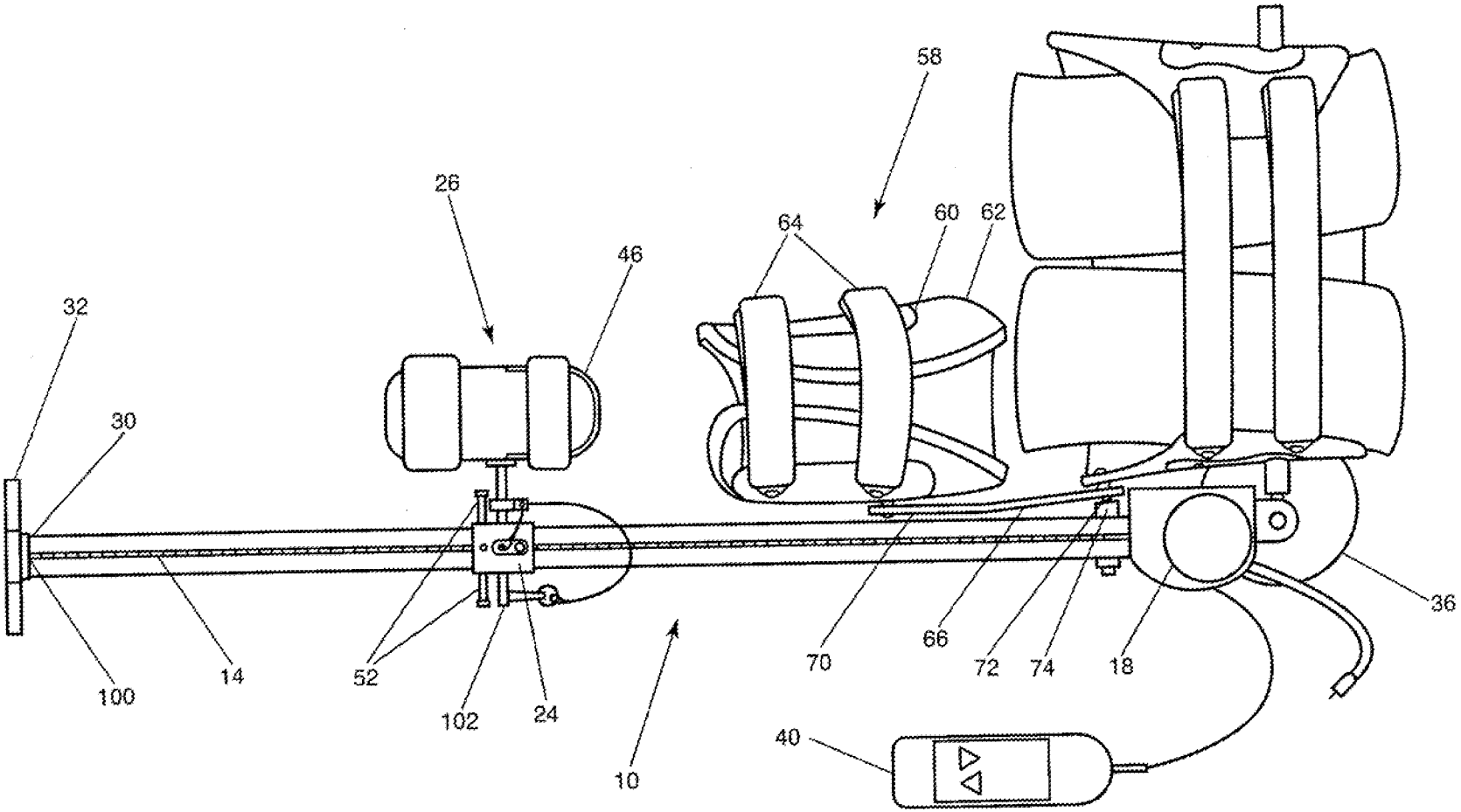
FIG. 6 is a top view of the preferred linear motion therapy device.
Figure 7:
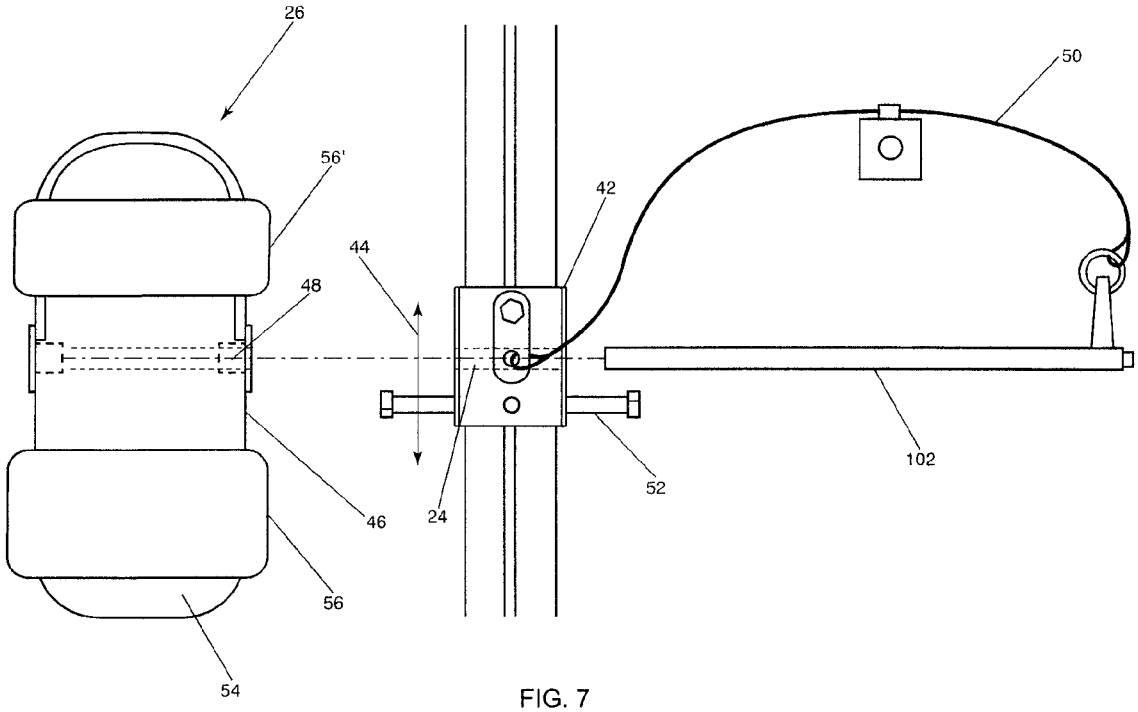
FIG. 7 is an exploded top view of the preferred footrest and its removable attachment to the rail.

FIG. 1A is a perspective view of the preferred embodiment of the linear motion therapy device (LMTD) 10 for use after surgery or trauma for rehabilitation of a knee, hip or ankle. FIG. 4 is a right side view of the preferred linear motion therapy device of FIG. 1A. FIG. 5 is a left side view of the preferred linear motion therapy device and FIG. 6 is a top view of the preferred linear motion therapy device. This apparatus is designed for use four to six weeks after trauma or surgery. As shown in the aforementioned figures, base or rail 12 is preferably constructed from metal such as aluminum; however, any strong material can be used. Disposed inside the base is threaded rod 14 with a first end 16 affixed to a motor 18 which supplies rotational force to worm-drive or threaded rod 14, as more clearly shown in FIG. 1B, which is a cut out view of A-A of FIG. 1A. Motor 18 is preferably electrically driven. Second end 100 of threaded rod 14 is disposed in a bearing or cup 20, allowing the rotational movement 22 of threaded rod 14. Disposed onto threaded rod 14 is a nut or worm receiver 24, which is affixed to footpad assembly 26 and provides telescopic linear movement 28 of footpad assembly when threaded rod 14 is rotated. A longitudinal slot 38 on a top end of base 12 allows for worm receiver 24 to traverse from front to back in a linear fashion. Front end of base 30 has a first base support 32, which is shown as a triangular member to keep LMTD 10 from rocking when in use. Back end of base 34 is a second or rear base support or foot 36. Foot 36 can be affixed to back end of base or to motor 18 which is affixed to back end of base 34, as shown. First base support 32 and foot 36 keep base 12 at a predetermined height above the surface, such as a table, floor, bed, or the like. Preferably, motor 18 rotates worm-drive in a clockwise and counterclockwise direction and the direction is based on a hand held control 40 which can be directly wired to motor 18 or wirelessly controlled. Any other type of device such as a hand crank or the like can be used to provide rotational movement to worm-drive. A measurement indicator 98, such as a scale, can be included on one or both sides of rail 12 in inches and/or centimeters to measure the range of motion.

In addition to FIGS. 1A, 4, 5, and 6, FIG. 7 shows the preferred footpad assembly 26. Affixed to worm receiver 24 is a carriage 42. Carriage 42 moves linearly in a front or back motion 44 as previously described. Removeably affixed to carriage 42 is foot support or footrest 46. Footrest 46 can be mounted to carriage 42 for a right foot or left foot by placing foot-rest 46 in the selected position and inserting pin 100 through an aperture in carriage 42 and into receiver aperture 48 in footrest 46. Pin 102 can have a spring-loaded ball on the end to keep it engaged. Pin 102 can also have a lanyard 50 affixed to carriage 42 as shown to prevent loss or misplacing it. Carriage 42 preferably has a stop 52 to keep footrest 46 from tilting more than 30 degrees or keep foot in plantar flexion. Footrest 46 preferably has a heel cup 54 to keep a patient's heel in place. Two straps 56 and 56' support the foot in footrest 46, strap 56 configured for ankle support, and second strap 56' configured to support the widest part to secure foot firmly with ankle starting in neutral position. Straps 56 and 56' are preferably made from a cloth or cloth-like material and are fastened with hook and loop fasteners or the like.

FIGS. 1A, 4, 5, and 6 show the preferred thigh support assembly 58. Thigh support assembly 58 is configured to support the thigh portion of a leg while the footrest 46 is telescopically moving. Thigh support assembly 58 is preferably a plastic molded semicircular support 60 with a cushion material 62 affixed to the inside for a patient's comfort. Two straps 64 are affixed with hook and loop fasteners around thigh support 60 to keep it snugly against a patient's thigh. Thigh support is affixed to an adjustable arm 66 on an adjustable arm first side 70 with bolts and nuts or the like. A plurality of adjustment apertures 68 is on adjustable arm 66 to conform to various leg sizes. An adjustable arm second side 72 is affixed to an interchangeable receiver 74, which can be used on a right or left side. Interchangeable receiver 74 is bolted or clamped onto base 12, as shown. Adjustable arm 66 is configured to move thigh support assembly 58 vertically in unison with the linear movement of footrest 46.

Figures 8A, 8B:
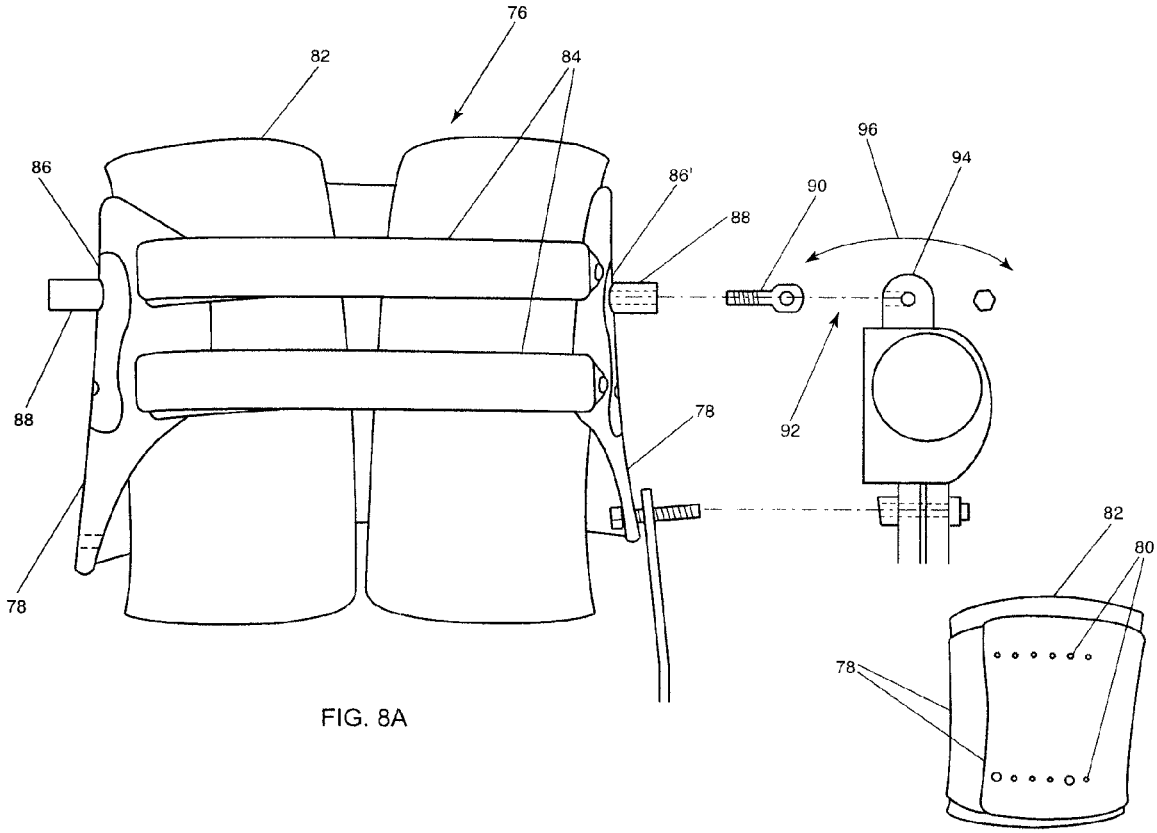
FIG. 8A is an exploded top view of the preferred exchangeable thoracic lumbar spine orthosis (TLSO) and its removable attachment to the rail.
FIG. 8B is a rear view of FIG. 8A showing the two-piece outer layer and adjustment area.
Figure 9:
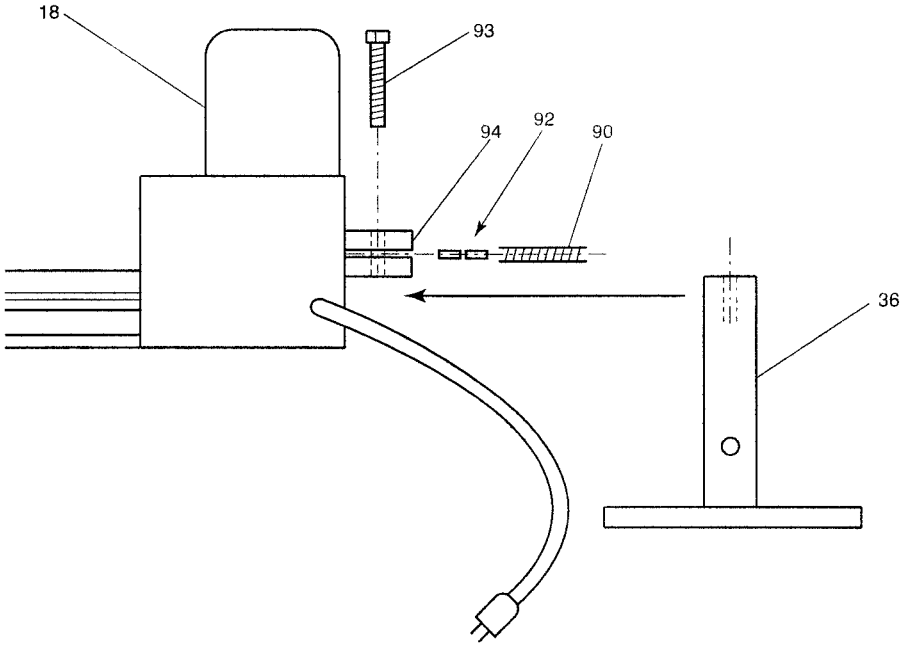
FIG. 9 is an exploded view of the motor and foot.

FIG. 8A is an exploded view of the preferred TLSO 76. TLSO is configured to support a patient's back and hips. This assembly keeps the patient's back and hips from lifting off the surface when a patient is bringing a knee into knee flexion. This configuration protects the back from other ailments such as stenosis, back pain, or the like. TLSO 76 preferably has an outer shell 78, which is a two piece semi rigid flexible material, such as plastic, that are oval shaped with a slit on the front side. As shown in FIG. 8B, by using two pieces, the back of the outer shell can be adjusted to fit differing sized torsos. Referring again to FIG. 8A, shell apertures 80 can be aligned or bolted together to vary the size of the shell as shown. Within outer shell 78 is a cushion type material 82, such as an Orthowick® liner which is hypo allergenic, for a user's comfort when TLSO 76 is worn and tightened. TLSO straps 84, comprising hook and loop fasteners, or the like are tightened around outer shell 78 to keep it firmly around the torso and to keep the patient's back and hips from lifting off the table or surface when patient is bringing the knee into knee flexion. Affixed to either side of outer shell 78 are attachment assemblies 86 and 86'. These assemblies are preferably constructed from a highly resilient material such as aluminum, steel or the like, and with an assembly affixed to a right side and another to a left side. Each attachment assembly 86 has a receiver 88 for receiving a bolt 90, pin, or the like to removably attach TLSO 76 to variable connector 92. Variable connector 92 is configured to connect bolt 90 to either a right side attachment assembly 86 or a left side attachment assembly 86'. The embodiments shown in FIGS. 8A and 9 show a slotted receiver 94 on motor or motor mount with the head of bolt 90 in the slot, allowing bolt 90 to be swung from one side to the other 96 to affix to the proper attachment assembly 86. This embodiment is configured to accommodate either a right leg or a left leg and can be easily changed to accomplish this with very few steps. Additionally, the LMTD 10 is configured to accommodate virtually all sizes of patients with its adjustability.

Figure 2:
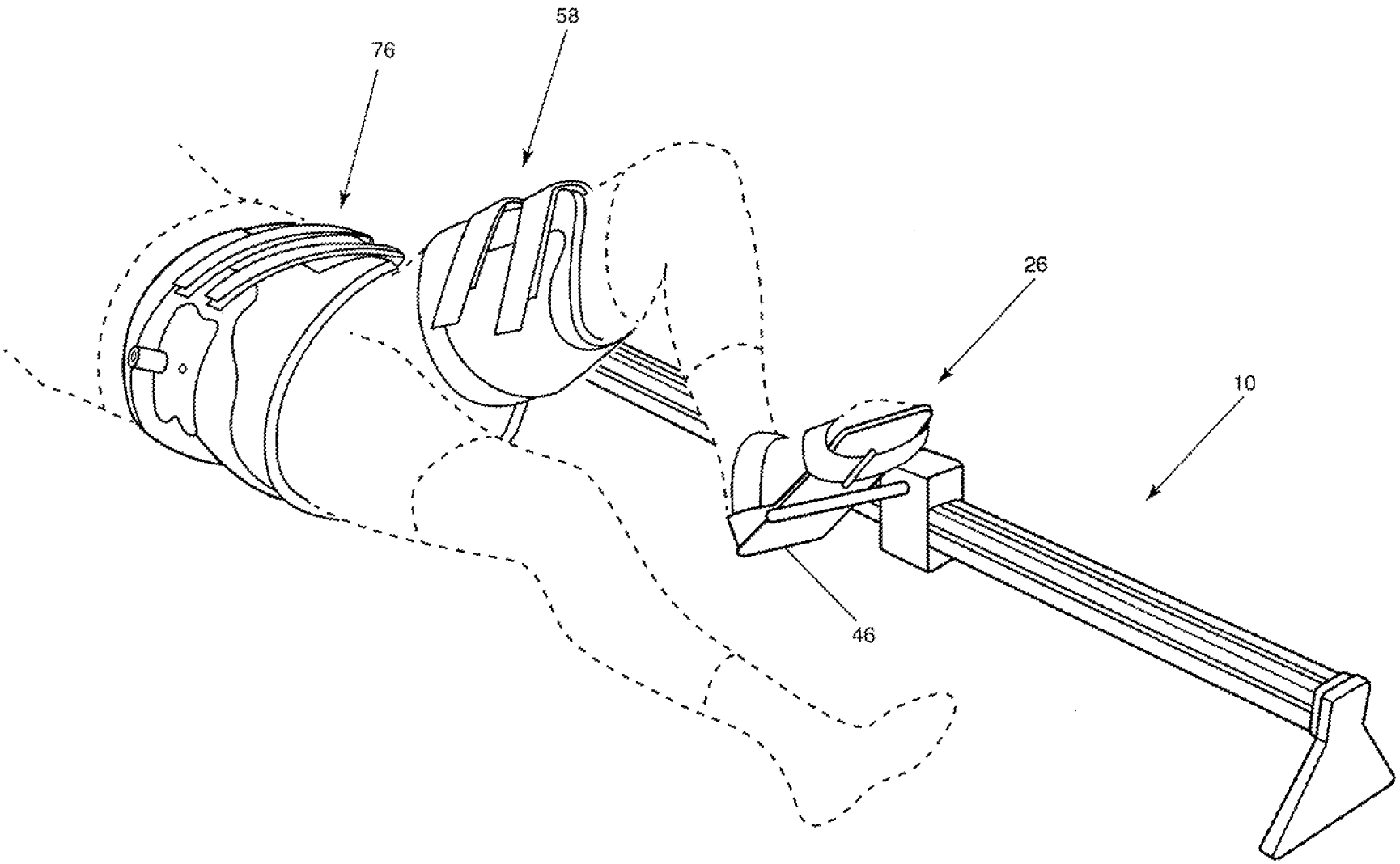
FIG. 2 is another perspective view of the linear motion therapy device affixed to a patient in a retracted position.
Figure 3:
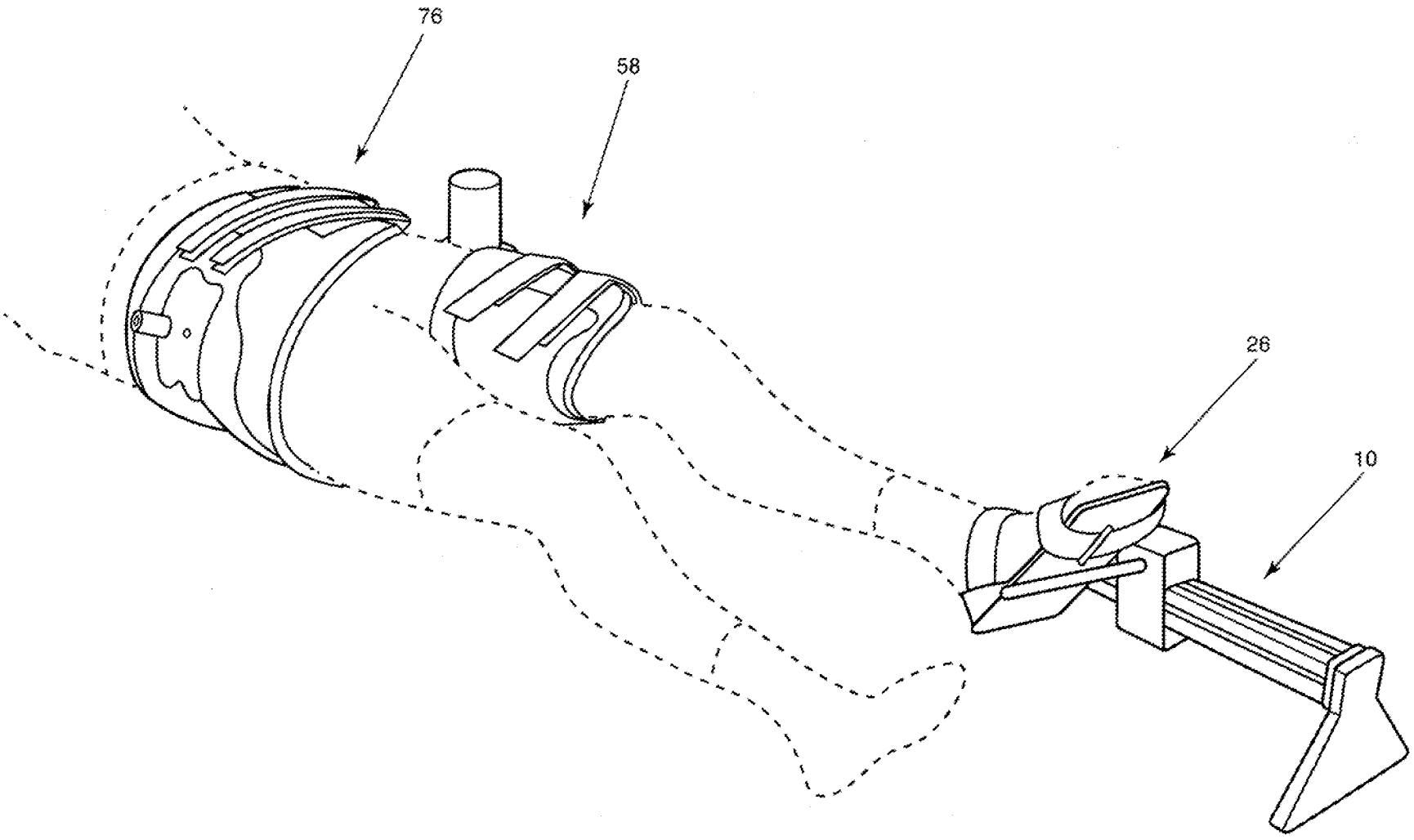
FIG. 3 is a perspective view of the linear motion therapy device affixed to a patient in an extended position.

FIGS. 2 and 3 show the operation of the LMTD 10. First, the LMTD is configured for the correct leg as described above and adjusted or sized to fit the patient. LMTD 10 is placed on the floor, therapy table, or bed with enough room for the patient to lay supine and plug the electrical cord into an electrical outlet. Next, foot support assembly 26 is adjusted by telescopically moving it into a position where the knee is comfortable and the patient is able to place foot on foot support. The patient lies within TLSO 76 and the thigh support 58, with the foot placed on the foot support 46. Patient or caregiver straps the foot first, then the thigh, followed by the TLSO so that it is snug to the patient's waist. Patient can now begin bending the knee. Using the hand control device 40, the patient, PT or PTA can push the up arrow to begin flexing the knee. The patient may stop the device by releasing (taking a finger off) the up or down button. This allows the patient to completely control how much flex is being allowed and can accommodate the patient's pain level. Patient can continue or reverse the machine (using the down arrow) striving for a maximum range of motion. The patient can also see his/her progress by looking at the measurement indicator 98 on the side of rail 12 that corresponds to the location of carriage 42.

Although the claimed invention has been described in detail with particular reference to these preferred embodiments, other embodiments can achieve the same results. Variations and modifications of the presently claimed invention will be obvious to those skilled in the art and it is intended to cover in all such modifications and equivalents. The entire disclosures of all references, applications, patents, and publications cited above, are hereby incorporated by reference.

What is claimed is:

1. A linear motion therapy apparatus comprising:

a base comprising a driven worm-drive;

a thoracic lumbar spine orthosis (TLSO) affixed to the base, the TLSO comprising a two piece rigid outer shell configured to fully encase a torso, the TLSO further comprising a plurality of corresponding shell apertures in both rigid outer shells for adjusting the two piece outer shell for different sized torsos;

a thigh support assembly affixed to a moveable arm, the moveable arm affixed to the base, wherein the moveable arm is pivotably affixed to the TLSO;

a footpad assembly affixed to a worm receiver disposed on the worm-drive; and an apparatus to provide clockwise and counterclockwise rotation to the worm-drive and provide telescopic linear movement to the footpad assembly.

2. The linear motion therapy apparatus of claim 1 wherein the footpad assembly comprises a pivoting footpad.

3. The linear motion therapy apparatus of claim 2 wherein the pivoting footpad further comprises at least one adjustable footpad fastener adapted to secure a foot inserted into the footpad and a heel cup.

4. The linear motion therapy apparatus of claim 2 wherein the pivoting footpad further comprises at least one stop to prevent the footpad from pivoting beyond a predetermined number of degrees.

5. The linear motion therapy apparatus of claim 1 where in the footpad assembly comprises a removable foot support for affixing to the footpad assembly for a left or a right foot.

6. The linear motion therapy apparatus of claim 1 wherein the TLSO comprises a removable TLSO for affixing to the base in a right or a left leg configuration.

7. The linear motion therapy apparatus of claim 1 wherein the TLSO comprises:

attachment assemblies on either side of the two piece outer shell assembly for affixing to the base for either the right or the left leg configuration;

a cushion material disposed on an inside of the two piece outer shell; and at least one adjustable fastener to tighten and loosen the TLSO.

8. The linear motion therapy apparatus of claim 1 wherein the thigh support assembly comprises:

a rigid semicircular support;

cushion material disposed on an inside of the rigid semicircular support; and at least one adjustable thigh support fastener adapted to secure and release a thigh.

9. The linear motion therapy apparatus of claim 1 wherein the moveable arm comprises:

at least one aperture for affixing the moveable arm to the base for a right or a left leg configuration, the at least one aperture configured to allow the moveable arm to move vertically; and a plurality of adjustment apertures configured to affix the thigh support assembly to the moveable arm to accept different leg lengths.

10. The linear motion therapy apparatus of claim 1 wherein the apparatus to provide clockwise and counter clockwise rotation to the worm-drive comprises a motor with controls to rotate the worm-drive in a clockwise or counterclockwise direction and to start and stop the rotation.

11. The linear motion therapy apparatus of claim 1 further comprising supports affixed to the base to keep the base at a predetermined height above a surface.

12. The linear motion therapy apparatus of claim 1 further comprising a scale affixed to the base to measure a range of motion.

13. A method for providing physical therapy targeted to a knee joint with a linear motion therapy device, the method comprises the steps of:

providing a base comprising a driven worm-drive, a thoracic lumbar spine orthosis (TLSO) affixed to the base, the TLSO comprising a two piece rigid outer shell configured to fully encase a torso, the TLSO further comprising a plurality of corresponding shell apertures in both rigid outer shells for adjusting the two piece outer shell for different sized torsos, a thigh support assembly affixed to a moveable arm, the moveable arm is pivotably affixed to the base and the TLSO, a footpad assembly affixed to a worm receiver disposed on the worm-drive and a motor to provide clockwise and counterclockwise rotation to the worm-drive and provide telescopic linear movement to the footpad assembly;

placing the patient into the linear motion therapy device;

activating the motor to provide rotation to the worm-drive in a first direction, activating the motor to provide rotation to the worm-drive in a second and opposite direction; and deactivating the motor to stop rotation to the worm-drive.

14. The method of claim 13 further comprising the step of configuring the TLSO, the thigh support assembly, and the footpad assembly for a selected leg.

15. The method of claim 13 wherein the step of placing the patient into the linear motion therapy device comprises:

adjusting the TLSO and thigh support assembly to fit the patient's torso and thigh;

telescopically adjusting the footpad assembly to where the patient is able to place the foot on the footpad assembly;

tightening foot support fasteners;

tightening thigh support fasteners; and tightening TLSO support fasteners.

16. The method of claim 13 wherein the steps of activating comprises pushing at least one button and deactivating comprises releasing the at least one button on a hand held controller.

17. The method of claim 16 wherein the step of pushing comprises pushing a first button to activate the motion in the first direction and pushing a second button to activate the motion in the second direction.

18. The method of claim 13 further comprising looking at a scale affixed to the base that corresponds to a location of the footpad assembly.

19. The method of claim 13 further comprising the step of preventing the patient's back and hips from lifting off a surface when the motor is activated.

20. The method of claim 13 further comprising the step of allowing the patient's thigh to move vertically when the motor is activated.

* * * * *